US005288071A

United States Patent [19]

Solomon

[11] Patent Number: 5,288,071

[45] Date of Patent: Feb. 22, 1994

[54] GAME APPARATUS

[76] Inventor: Allen C. Solomon, Rte. 1, Box 74c, Stephenville, Tex. 76401

[21] Appl. No.: 985,335

[22] Filed: Dec. 4, 1992

[51] Int. Cl.[5] ..... A63F 7/20

[52] U.S. Cl. ..... 273/85 C; 273/85 F; 273/85 H; 273/355; 273/129 AP

[58] Field of Search ..... 273/85 C, 85 F, 85 H, 273/317, 324, 336, 337, 340, 343, 357, 119 R, 127 R, 129 R, 129 AP, 129 T, 355, 356, 118 A, 126 A, 460, 85 A; 446/178, 179

[56] References Cited

U.S. PATENT DOCUMENTS

| | | | |
|---|---|---|---|
| 905,085 | 11/1908 | Lexon | 273/355 |
| 1,756,299 | 4/1930 | Owens | 273/355 |
| 1,827,885 | 10/1931 | Emenhiser | 273/85 H |
| 2,114,777 | 4/1938 | Englerth | 273/355 |
| 2,201,025 | 5/1940 | Cadman | 273/85 H |
| 2,924,033 | 2/1960 | Langtot | 446/178 X |
| 3,033,568 | 5/1962 | Achterberg | 273/355 |
| 3,038,725 | 6/1962 | Stewart et al. | 273/129 AP |
| 3,537,707 | 11/1970 | Goldberg | 273/355 |
| 3,622,160 | 11/1971 | Barfield | 273/85 C X |
| 3,901,508 | 8/1975 | Spangler | 273/85 C |
| 3,960,378 | 6/1976 | Bahr | 273/85 H |
| 4,010,953 | 3/1977 | Russo | 273/85 C |
| 4,079,937 | 3/1978 | Kirsch | 273/357 X |
| 4,292,755 | 10/1981 | Houn | 446/179 X |
| 4,325,555 | 4/1982 | Marling | 273/355 |
| 5,104,124 | 4/1992 | Bernard et al. | 273/129 R X |

FOREIGN PATENT DOCUMENTS

| | | | |
|---|---|---|---|
| 1590088 | 8/1990 | U.S.S.R. | 273/129 AP |
| 1742 | of 1890 | United Kingdom | 273/85 H |
| 2185899 | 8/1987 | United Kingdom | 273/85 H |

*Primary Examiner*—Mark S. Graham
*Assistant Examiner*—Sebastiano Passaniti
*Attorney, Agent, or Firm*—James E. Bradley

[57] ABSTRACT

A game apparatus which consists of a substantially rectangular base having a flat surface. A vertical plate is suspended over an end of the base by a support and has a hoop horizontally attached to the plate. A catapult is pivotally mounted to the opposite end of the base and has a receptacle for holding a ball which can be projected toward the hoop. An air nozzle, which is connected to a pressurized air supply, can be used by an opponent for deflecting the path of the ball after it has been projected from the catapult.

19 Claims, 3 Drawing Sheets

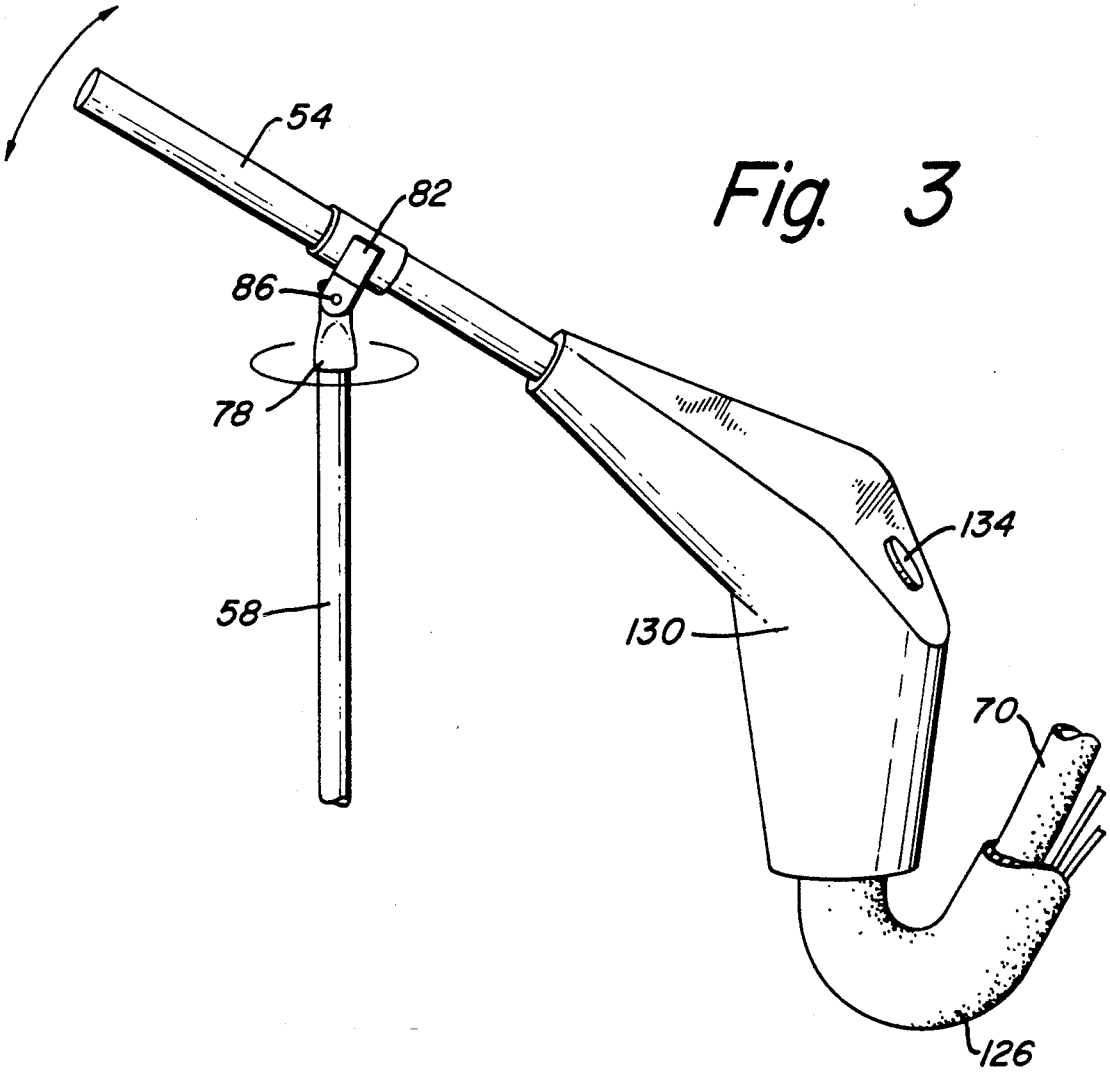
Fig. 3
Fig. 4
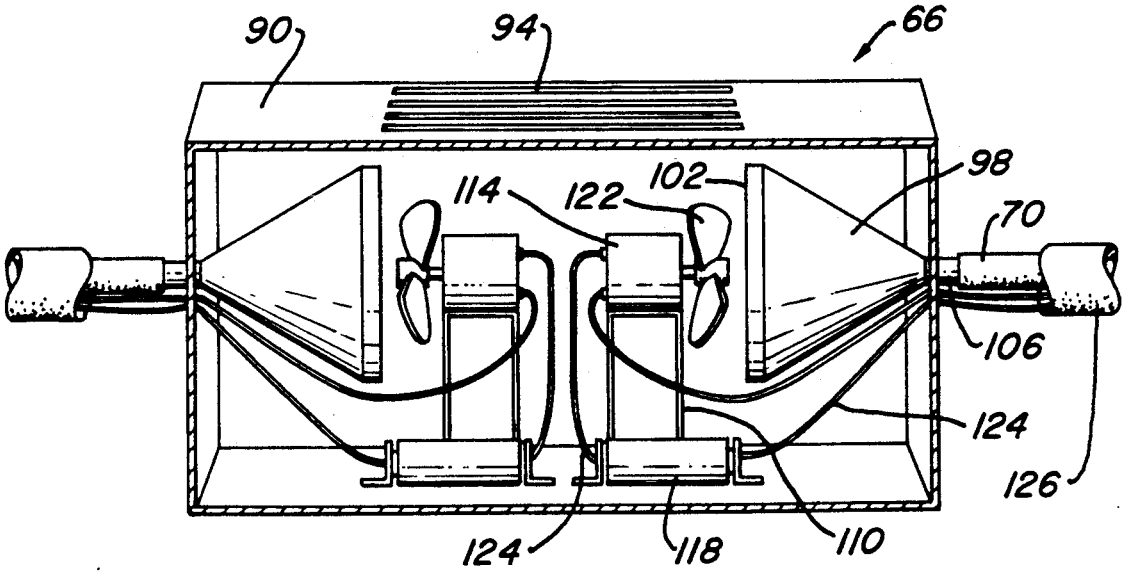

GAME APPARATUS

BACKGROUND OF THE INVENTION

1. Field of the Invention

This invention relates to a game apparatus for games which involve projecting an object from one end of a board toward a target mounted on an opposite end of the board, and providing a means for deflecting the object after it has been projected.

2. Description of the Prior Art

A number of games provide a board or base in which a target is mounted to one end of the base, and a means for projecting a ball or other object toward the target is located at an opposite end of the base. This usually involves some kind of catapult or other projecting means for projecting the object toward the target. The target is often a small hoop similar to ones used in the game of basketball. Skill is required in hitting the target with the object.

In the prior art, only one player plays at a time. If the game is played against an opponent, one player must remain inactive while the game is being used by the other player.

SUMMARY OF THE INVENTION

This invention relates to a game apparatus which can be used by two or more players. It consists of a substantially rectangular base which has a flat surface. A vertical plate with a horizontal hoop is attached to one end of the base by a support. A catapult is pivotally mounted to an end of the base and has a receptacle for holding a ball or other object. A player can project the ball or object toward the hoop by pulling back on the catapult and then releasing it. An air nozzle is mounted along the side of the base and is connected to an air supply which an opponent may use to deflect the ball after it has been projected from the catapult.

BRIEF DESCRIPTION OF THE DRAWINGS

FIG. 3 is a side view of the air nozzle of FIG. 2.

FIG. 4 is a cross-sectional view of the blower used with the embodiment of FIG. 2.

DETAILED DESCRIPTION OF THE INVENTION

Figure 1:
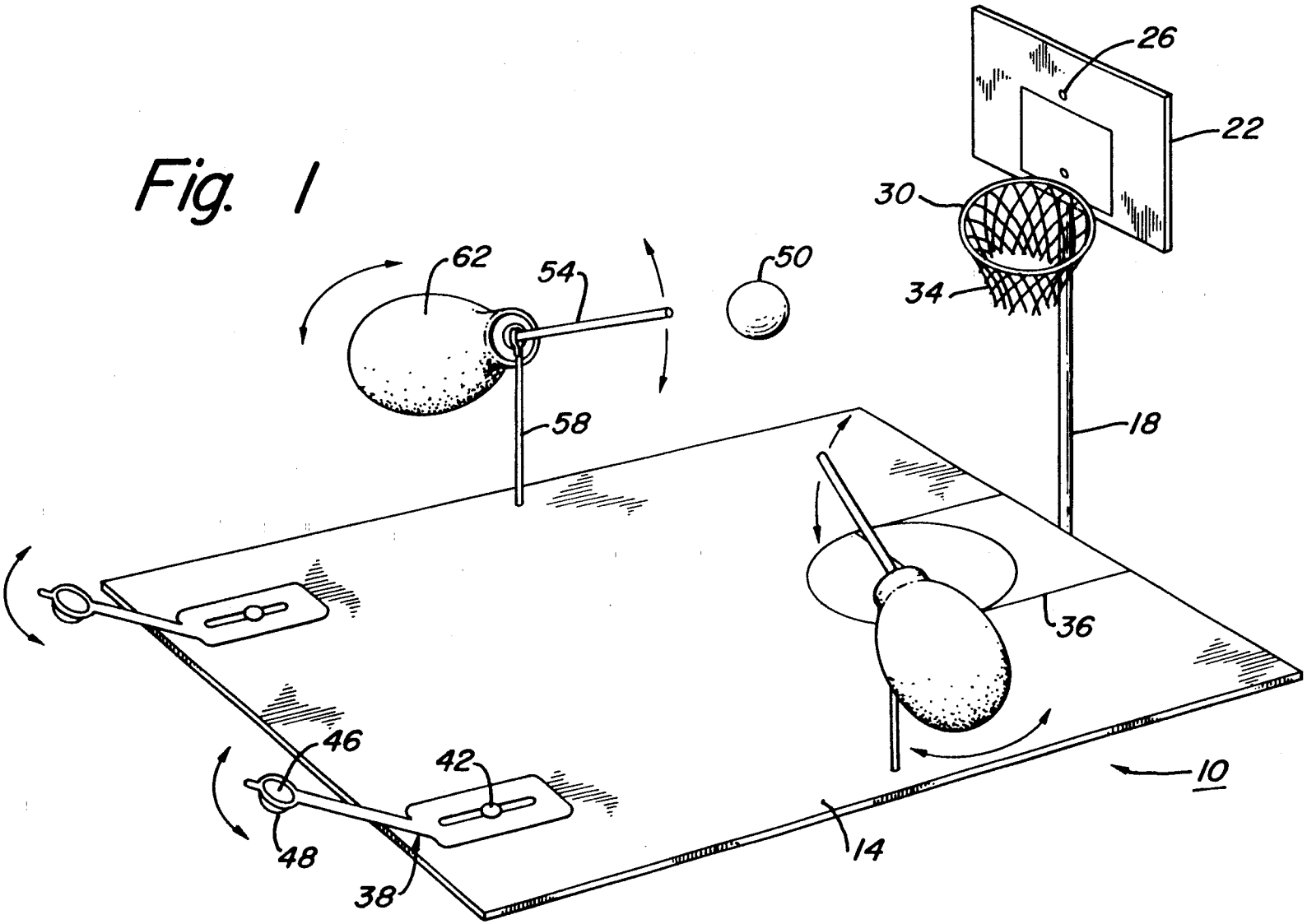
FIG. 1 shows a perspective view of one embodiment of the game apparatus with air nozzles attached to squeeze bulbs.

Referring to FIG. 1, the game apparatus 10 includes a base 14. The base 14 has a flat surface and is substantially rectangular in shape. A vertical support 18 is mounted to a rearward end of the base 14. The support 18 supports a plate or backboard 22 which is mounted to the support by either bolts or rivets 26. A goal comprising a horizontal hoop 30 is attached to the plate 22. A net 34 may be attached to the hoop 30 so that the hoop 30 appears similar to those used in the game of basketball. The surface of the base 14 may also have lines or markings 36 to give the base 14 a similar appearance to a basketball court.

A projection means comprising a catapult 38 is mounted to the opposite end of the base 14 by means of a bolt or rivet 42. The catapult 38 is mounted so that it can be moved in a horizontal plane from side to side as indicated by the arrows. The catapult 38 is supplied with a receptacle 46 which may consist of a concave area on the free end 48 of the catapult 38. The catapult 38, as shown in FIG. 1, is a single piece of resilient material, such as metal or plastic, that will spring back to its original position after it has been deflected. In the embodiment shown, there are two catapults 38 on the forward end of the base 14 opposite the plate 22.

A playing element 50, preferably a ball, should fit into the receptacle 46 so that it maintains its position as the catapult 38 is being deflected. The ball 50 can be a ping pong ball, a perforated golf practice ball, or any type of playing element that can be easily propelled along a trajectory by catapult 38. Also, the ball 50 should be light enough so that it can be deflected from its path or trajectory by a light stream of air blown transversely to the trajectory path.

As seen from FIG. 1, the deflection means includes at least one air nozzle 54 located at the side of the base 14 substantially midway between the ends of the base 14. The air nozzle 54 is attached to a stand 58 so that it is pivotal both horizontally and vertically. In the embodiment of FIG. 1, the air nozzle 54 is attached to a squeeze bulb 62 which provides a pressurized air supply when it is squeezed. Preferably, two nozzles 54 are employed, one on each side of base 14.

In using the game apparatus 10 of FIG. 1, a first player will place a ball 50 in one of the receptacles 46. The first player will then deflect the catapult 38, positioning it so that the ball 50 will be projected through the hoop 30 when the catapult 38 is released. By squeezing the squeeze bulb 62 of the air nozzle 54, a second player can provide a stream of air which will deflect the ball 50 from its projected path and away from the hoop 30.

The game apparatus 10 shown in FIG. 1 may be played by two to four players. If four players use the game apparatus 10, two opponents can operate the catapults 38 while their teammates operate the air nozzles 54. The players operating the air nozzles 54 must be careful to avoid deflecting their teammate's ball.

Figure 2:
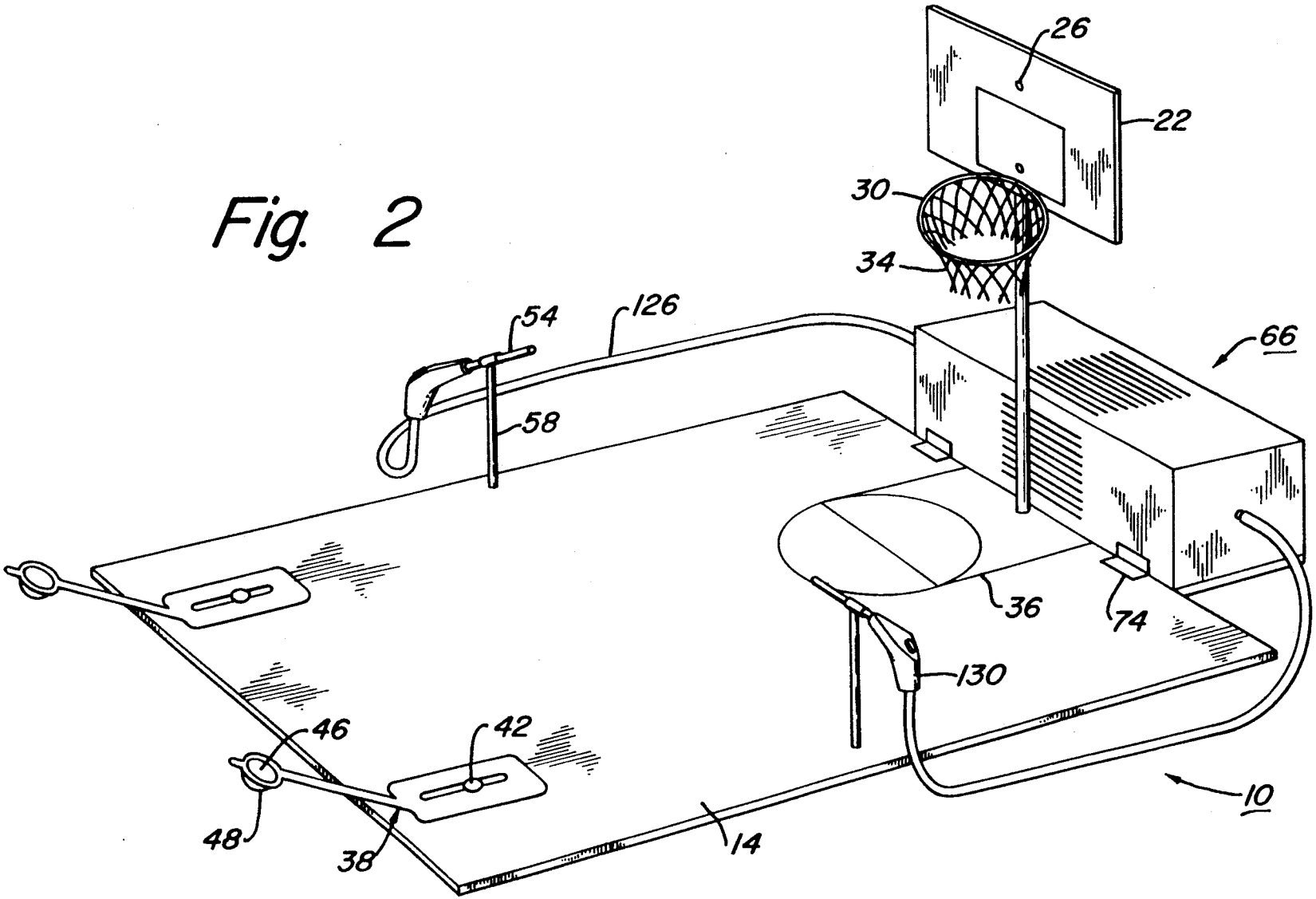
FIG. 2 shows a perspective view of an alternate embodiment of the air nozzle in which a blower is connected to the air nozzle by a hose.

FIG. 2 shows an alternate embodiment of the game apparatus 10. In FIG. 2, a blower 66 supplies pressurized air to the air nozzle 54 by means of a duct or hose 70 (FIG. 3). The blower 66 may be attached to the base 14 by brackets 74.

FIG. 3 shows a detailed side view of the air nozzle 54. The air nozzle 54 is attached to the stand 58 by a sleeve 78 which mounts over the top of the stand 58. The stand 58 has a circular cross section so that the sleeve 78 can be rotated around the top of stand 58, as indicated by the arrow, providing horizontal motion. The air nozzle 54 is attached to the stand 58 by a collar 82 which fits around the air nozzle 54. The collar 82 hinges to the sleeve 78 by means of a pin 86. The hinge allows the air nozzle to be pivoted up and down as indicated by the arrows.

FIG. 4 shows a cross-sectional view of the blower 66. The blower 66 consists of a case 90 which surrounds the internal components of the blower 66. The surface of the case 90 has slots 94 which allow air to flow into the case 90. Inside the case 90 are two funnels 98. The large opening 102 of each funnel 98 is directed inward inside the case 90. The spout 106 of the funnel 98 protrudes through the case 90. A base 110 is located inside the case 90 for supporting motors 114. The motors 114 may be powered by batteries 118 or may be powered by an external electrical supply (not shown). Each motor 114 drives a fan 122 which blows air into the opening 102. The batteries 118 are connected to the motors 114 by wires 124 which form a complete electrical circuit.

The hose 70 is fitted over the spout 106 of the funnel 98 and is encased in conduit 126. The wires 124 are also encased inside this conduit 126. The hose 70 and wires 124 are connected to a handle 130 of the air nozzle 54 as shown in FIG. 3. A button 134 is attached to the handle 130. The button 134 comprises an electrical switch for opening and closing the electrical circuit to the motors 114. By depressing the button 134, the motor 114 is switched on and begins turning the fan 122.

Operation of the second embodiment of the game apparatus 10 is similar to the first embodiment. A first player will place a ball 50 in one of the receptacles 46. The first player will then deflect the catapult 38, positioning it so that the ball 50 will be projected through the hoop 30 when the catapult 38 is released. A second player, by depressing the button 134 of the air nozzle 54, completes the electrical circuit to the motor 114 providing a stream of air which can deflect the ball 50 from its projected path and away from the hoop 30. The second embodiment can also be played by two to four players.

The present game apparatus allows at least two players to play simultaneously. Skill is required in both the operation of the catapult and the air nozzle. This is an improvement over the prior art which only involves launching an object from a catapult to a target. The present game apparatus requires a higher degree of skill because the player launching the ball must take into account his opponent who is operating the air nozzles.

While the invention has been shown in only one of its forms, it should be apparent to those skilled in the art that it is not so limited, but is susceptible to various changes without departing from the scope of the invention.

I claim:

1. A game apparatus comprising:

a base having two spaced apart side edges and two spaced apart ends;

a target mounted to one end of the base;

a catapult mounted to the other end of the base for projecting a playing element along a path through the air toward the target;

deflection means located adjacent to one of the side edges of the base for directing a stream of air across the base toward the other side edge into the path of the element as it is projected toward the target.

2. The game apparatus of claim 1, wherein:

the catapult is pivotally mounted to the base, and has a receptacle for holding the element in place before it is projected.

3. The game apparatus of claim 1, further comprising a stand mounted at a stationary point to the base, and wherein:

the deflection means comprises at least one air nozzle pivotally mounted to the stand, the air nozzle being pivotal about more than one axis.

4. The game apparatus of claim 3, further comprising:

a manual squeeze bulb connected to the air nozzle for supplying pressurized air to the nozzle.

5. The game apparatus of claim 3, further comprising:

electrically actuated means for supplying pressurized air to the nozzle.

6. The game apparatus of claim 3, further comprising:

an electrically operated blower;

duct means connected between the blower and the nozzle for delivering air to the nozzle from the blower; and switch means for selectively energizing the blower.

7. A game apparatus comprising:

a substantially flat base having a forward end and a rearward end spaced longitudinally apart from each other and two side edges spaced laterally apart from each other;

a goal supported above the rearward end of the base;

at least one projection means comprising a catapult pivotally mounted to the forward end for projecting a playing element along a path towards the goal;

a stand mounted to the base at a stationary point adjacent one f the side edges of the base, extending vertically from the base and having an upper end spaced above the base; and at least one air nozzle means pivotally mounted to the upper end of the stand for horizontal and vertical movement relative to the base for directing a stream of air laterally into the path of the playing element after it has been projected from the projection means.

8. The game apparatus of claim 7, wherein:

the air nozzle means comprises a squeeze bulb connected to an air nozzle.

9. The game apparatus of claim 7, wherein the air nozzle means comprises:

a nozzle;

an electrically operated blower;

duct means connected between the blower and the nozzle for delivering air to the nozzle from the blower; and switch means for selectively energizing the blower.

10. The game apparatus of claim 7, wherein the goal comprises a hoop mounted horizontally.

11. The game apparatus of claim 7, wherein:

there are two air nozzle means, one mounted on either side of the base; and there are two of the projection means.

12. A game apparatus comprising:

a base having a substantially flat surface, a forward end and a rearward end longitudinally spaced apart from each other and two side edges laterally spaced apart from each other;

a vertically oriented plate suspended over the rearward end of the base by a support, wherein a surface of the plate is facing the forward end of the base;

a horizontal hoop attached to the plate surface;

at least one catapult pivotally mounted to the forward end of the base opposite the hoop and having a receptacle for holding a ball in place for projecting the ball along a path towards the hoop;

a stand mounted to the base at a stationary point adjacent one of the side edges;

at least one air nozzle pivotally mounted to the stand; and a squeeze bulb mounted to the nozzle for supplying an air stream through the nozzle laterally relative to the path of the ball for deflecting the ball after it has been projected from the catapult.

13. The game apparatus of claim 12, wherein there are two of the air nozzles, one mounted on either side of the base; and there are two of the catapults.

14. A game apparatus comprising:

a base having a substantially flat surface, a forward end and a rearward end longitudinally spaced apart from each other and two side edges laterally spaced apart from each other;

a vertically oriented plate suspended over the rearward end of the base by a support, wherein a surface of the plate is facing the forward end of the base;

a horizontal hoop attached to the plate surface;

at least one catapult pivotally mounted to the forward end of the base opposite the hoop and having a receptacle for holding a ball in place for projecting the ball along a path towards the hoop;

a stand mounted to the base at a stationary point adjacent one of the side edges;

at least one air nozzle pivotally mounted to the stand;

an electrically operated blower having duct means connected between the blower and the nozzle for delivering air to the nozzle from the blower for directing air laterally relative to the path of the ball to deflect the ball; and a switch means for selectively energizing the blower.

15. The game apparatus of claim 14, wherein:

there are two of the air nozzles, one mounted on either side of the base; and there are two of the catapults.

16. A method for playing a game, which comprises:

providing a base having two spaced apart side edges and two ends;

providing a target mounted to an end of the base;

projecting a playing element through the air toward the target by means of a catapult mounted to the base; and directing a stream of air from a side edge of the base transverse to and into the path of the element as it is projected toward the target.

17. The method for playing the game of claim 16, wherein the step for projecting the playing element consists of:

placing the playing element into a receptacle of the catapult;

orienting the catapult so that it is oriented in the direction of the target;

deflecting the catapult to a deflected position; and releasing the catapult from the deflected position.

18. The method for playing the game of claim 16, wherein the step for directing the stream of air consists of:

providing at least one air nozzle pivotally mounted along a side of the base;

attaching a squeeze bulb to the air nozzle;

directing the air nozzle toward the playing element as it is projected toward the target; and squeezing the bulb so that air is forced through the nozzle.

19. The method for playing the game of claim 16, wherein the step for directing the stream of air consists of:

providing an electrically operated blower;

providing at least one air nozzle pivotally mounted along a side of the base, and having a switch which can be depressed to energize the blower;

attaching a duct between the blower and the air nozzle for delivering air to the nozzle from the blower;

directing the air nozzle toward the playing element as it is projected toward the target; and depressing the switch so that the blower is energized.

* * * * *